US009708096B2

(12) United States Patent
Dill et al.

(10) Patent No.: US 9,708,096 B2
(45) Date of Patent: Jul. 18, 2017

(54) SELF-OPENING CLOSURE WITH OPTIMIZED FORCE TRANSMISSION

(71) Applicant: Terxo AG, Wetzikon (CH)

(72) Inventors: Fritz Dill, Langenthal (CH); David Koller, Fislisbach (CH); Markus J. Schellenberg, Wermatswil (CH)

(73) Assignee: Terxo AG, Wetzikon (CH)

( * ) Notice: Subject to any disclaimer, the term of this patent is extended or adjusted under 35 U.S.C. 154(b) by 0 days.

(21) Appl. No.: 15/027,753

(22) PCT Filed: Sep. 19, 2014

(86) PCT No.: PCT/EP2014/069988

§ 371 (c)(1),
(2) Date: Apr. 7, 2016

(87) PCT Pub. No.: WO2015/058912

PCT Pub. Date: Apr. 30, 2015

(65) Prior Publication Data

US 2016/0229582 A1 Aug. 11, 2016

(30) Foreign Application Priority Data

Oct. 25, 2013 (CH) ..... 1803/13

(51) Int. Cl.
*B65D 5/74* (2006.01)

(52) U.S. Cl.
CPC ..... *B65D 5/747* (2013.01); *B65D 5/748* (2013.01)

(58) Field of Classification Search
CPC ..... B65D 25/40; B65D 5/747; B65D 5/748; B65D 5/74

(Continued)

(56) References Cited

U.S. PATENT DOCUMENTS

2009/0302037 A1* 12/2009 Rigling ..... B65D 5/748 220/258.4
2010/0237073 A1 9/2010 Alther et al.
2010/0264146 A1* 10/2010 Casale ..... B65D 5/029 220/278

FOREIGN PATENT DOCUMENTS

DE 10 2006 016113 B3 8/2007
DE 10 2010 029069 A1 11/2011

(Continued)

OTHER PUBLICATIONS

International Preliminary Report on Patentability dated May 6, 2016 from the International Bureau in counterpart application No. PCT/EP2014/069988.

(Continued)

*Primary Examiner* — King M Chu
(74) *Attorney, Agent, or Firm* — Sughrue Mion, PLLC

(57) ABSTRACT

The invention relates to a self-opening closure with a pouring spout (12), a self-opening sleeve (20) which is guided in the connector in a helical manner, and a cover (30) which covers the pouring spout (12). A driver cam (24) is formed on the self-opening sleeve, said driver cam defining a guide surface (241). The cover has a driver (34) which defines a front edge (341). The front edge interacts with the guide surface of the driver cam. The front edge and the guide surface are inclined by the same angle of inclination relative to the longitudinal axis in order to allow an optimal force transmission between the cover and the self-opening sleeve. Additionally, the guide surface can be designed in a concave manner, and the front edge of the driver can be rounded in a corresponding manner in order to prevent a radial deflection of the driver towards the inside.

19 Claims, 3 Drawing Sheets

(58) Field of Classification Search
USPC ..... 206/219, 222; 222/80, 83, 83.5;
220/255.1, 366.1, 258.4, 259.3
See application file for complete search history.

(56) References Cited

FOREIGN PATENT DOCUMENTS

| | | | |
|---|---|---|---|
| DE | 10 2011 080209 | A1 | 2/2013 |
| EP | 1 088 764 | A1 | 4/2001 |
| EP | 1 571 095 | A1 | 9/2005 |
| WO | 03/002419 | A1 | 1/2003 |
| WO | 2004/000667 | A1 | 12/2003 |
| WO | 2006/050624 | A1 | 5/2006 |
| WO | 2008/092289 | A2 | 8/2008 |

OTHER PUBLICATIONS

International Search Report of PCT/EP2014/069988 dated Dec. 11, 2014 [PCT/ISA/210].

* cited by examiner

SELF-OPENING CLOSURE WITH OPTIMIZED FORCE TRANSMISSION

CROSS REFERENCE TO RELATED APPLICATIONS

This application is a National Stage of International Application No. PCT/EP2014/069988, filed Sep. 19, 2014, claiming priority based on Swiss Patent Application No. 01803/13, filed Oct. 25, 2013, the contents of all of which are incorporated herein by reference in their entirety.

TECHNICAL FIELD

Prior Art

Pourable food products, such as drinks, are frequently packed in composite packagings. In such packagings, a cardboard support is usually coated on both sides with plastic, usually polyethylene (PE). In order to create an oxygen barrier, a barrier layer of aluminum or of an oxygen-impermeable plastic, such as EVOH, and auxiliary layers for lamination of the barrier layer are frequently additionally present. It is known to weaken the packaging wall in the region to be opened, in order to facilitate opening, for example by a weakening line being punched into the cardboard support, or by a complete hole being punched out of the cardboard support prior to the lamination of the films.

In order to open packagings of this type, various self-opening closures, in which a self-opening sleeve, which usually has a plurality of teeth, is threadedly guided in a pouring spout, have become known from the prior art. When it is unscrewed for the first time, a screw cap cooperates with the self-opening sleeve such that the latter moves helically downward and hereupon, with its teeth, pierces or cuts open the underlying packaging wall. In order to transport the self-opening sleeve, one or more drivers are configured on the screw cap, which drivers cooperate with corresponding driving cams on the inner peripheral wall of the self-opening sleeve. Generally the drivers have a front edge which runs parallel to the longitudinal axis of the pouring spout and points in the circumferential direction and which cooperates with a face, likewise pointing in the circumferential direction, of the corresponding driving cam. This is the case, for example, in EP 1 088 764 A1, in WO 03/002419 A1 or WO 2008/092289 A2.

Self-opening closures frequently require a relatively large force application in order to generate on the cap the torque which is necessary for the first-time opening. Specifically for elderly persons or persons restricted by illness, the necessary forces can be applied only with difficulty. It is therefore desirable to minimize as far as possible the torque which is necessary for the first-time opening.

WO 2004/000667 A1 and WO 2006/050624 A1 disclose self-opening closures in which the self-opening sleeve does not execute a screw-like movement, but rather, when the closure is opened for the first time, is firstly pushed axially downward without rotation and subsequently executes a pure rotation. In order to enforce this form of movement, on the inner side of the pouring spout and the outer side of the self-opening sleeve corresponding vertically and horizontally running ribs are provided. The cap has drivers in the form of cylinder wall segments, the respective front edge of which runs firstly at an acute angle obliquely to the cap face and subsequently perpendicular to the cap face, i.e. axially. That region of the front edge of the drivers which runs obliquely to the cap face cooperates with driving cams on the self-opening sleeve in order to push these firstly perpendicularly downward when the cap is unscrewed, while the axially running region of the front edge serves to transport the driving cams subsequently in the peripheral direction and to thereby set the self-opening sleeve in a pure rotation. Since, in closures of this kind, the distance which the self-opening sleeve covers in its initial axial movement against the resistance of the packaging wall is very short, even greater opening forces than in closures having thread-guided self-opening sleeves have to be surmounted in such closures.

SUMMARY OF THE INVENTION

An object of the present invention is to define a self-opening closure by which a packaging can be opened with reduced force expenditure. At the same time, it should be possible to produce such a closure easily and with low material costs.

Proposed is a self-opening closure which comprises:

- a tubular pouring spout, which defines a longitudinal axis and is provided on its inner side with an internal thread,
- a cap, which upwardly covers the pouring spout and which, for the purpose of opening the closure, is rotatable relative to the pouring spout in an opening direction and, for the purpose of reclosing the closure, is rotatable in a closing direction opposite to the opening direction, wherein the cap has at least one driver, which defines a front edge; and
- a self-opening sleeve, which is provided with an external thread that engages in the internal thread of the pouring spout, and which on its inner side has at least one driving cam, wherein the driving cam defines a guide face which, when the closure is opened, cooperates with the front edge of the driver in order to move the self-opening sleeve in a screw-like manner downward out of its starting position in the pouring spout,
- wherein the front edge runs inclined downward by a first angle of inclination relative to the longitudinal axis, and wherein the guide face runs inclined by the same angle of inclination as the front edge.

This design is based on the recognition that, in self-opening closures of the prior art in which the front edge of the driver runs parallel to the rotational axis, the force transmission between the cap and the self-opening sleeve is not optimally achieved if the self-opening sleeve executes a screw-like movement. In the case of a driver edge running parallel to the rotational axis, the opening torque applied to the cap by the user is transmitted precisely in the peripheral direction, i.e. the opening torque is converted into a pure torque at the self-opening sleeve. In actual fact, however, by executing a screw-like movement, the self-opening sleeve not only moves in the peripheral direction, but also has a motional component downward in the axial direction. It is therefore better if the opening torque is converted both into a torque bearing against the self-opening sleeve and into an axial force acting downward onto the self-opening sleeve. The present invention ensures an optimal force transmission, since the front edge (situated at the front with respect to the opening direction) of the driver is inclined downward and cooperates with a correspondingly inclined guide face on the driving cam. As a result, the opening torque is partially converted into a torque bearing against the self-opening sleeve and partially into an axial force. At the same time, the forces between driver and driving cam which are at play during the opening process are in this way distributed particularly evenly onto the guide face of the driving cam.

As a result, the frictional forces which act between driver and driving cam are minimized. In total, the torque which is necessary to open the closure for the first time is thus reduced.

The angle of inclination of the front edge of the driver is preferably greater than or equal to the pitch angle of the internal thread, but in any case amounts to at least 50% of the pitch angle of the internal thread in the pouring spout, in order to generate a sufficiently large force component in the downward direction. In practice, an angle of inclination of the front edge of about 10°-30° has proved successful.

The cap usually has a cover wall and a circumferential side wall. On the inner side of the side wall are usually configured one or more guide structures, which effect a guidance of the cap on the pouring spout. Preferably, these guide structures are constituted by a single or multiple internal thread, but e.g. a bayonet guide, in which the cap, when opened, firstly performs a pure rotation and can subsequently be pulled off axially, can also be provided. On the pouring spout are usually likewise configured one or more guide structures, which are complementary to the guide structures on the cap. If, for example, an internal thread is provided on the cap, the guide structure on the pouring spout is constituted by a thereto complementary external thread. The driver is preferably attached to the cover wall of the cap and, starting from the cover wall, preferably extends downward. It preferably has the basic shape of a cylinder wall segment, wherein the front edge of the cylinder wall segment forms the aforementioned front edge of the driver and is accordingly inclined relative to the longitudinal axis. Preferably, precisely one driver is present.

In order to prevent the driver from evading the opening forces in the radially inward direction when the closure is opened for the first time, the guide face is preferably not flatly, but concavely configured with respect to the radial direction, so that it at least partially embraces the front edge of the driver when the closure is opened. Accordingly, the front edge of the driver is preferably curved correspondingly convexly.

Preferably, the guide face has no sharp bends. In this way, a situation in which the driver and the driving cam hook together in such a way that the opening operation is impeded can be avoided. Preferably, the front edge of the driver has a shape which is at least in one area complementary to the shape of the guide face of the driving cam. As a result, at least a region of the guide face bears squarely and not just at certain points against the front edge of the driver when the closure is opened. The guide face preferably bears along the whole of its length against the front edge of the driver, wherein "length" is here denoted as the extent parallel to the front edge of the driver. As a result, the forces at play during the opening process are transmitted over a greater region, i.e. the pressure (force per unit of area) is thus diminished. An optimal slideway between driver and driving cam is hereby ensured. Preferably, the length of the guide face is at least 2 mm.

Preferably, the closure is configured such that the self-opening sleeve, after the closure has been opened for the first time, remains in its lower end position, i.e. is not transported back upward in the direction of its starting position by the driver when the closure is reclosed. In order to enable this, the driving cam is preferably of ramp-shaped configuration in a region situated, with respect to the opening direction, before the guide face, with a slide face directed inward obliquely to the opening direction, which slide face merges smoothly (without steps) into an inner cylindrical lateral surface of the self-opening sleeve. When the closure is reclosed, the driver then slides with its rear edge over the ramp-like slide face of the driving cam, so that the driver, upon reclosure by the driving cam, deflects radially inward and slides past the driving cam.

In order to facilitate the sliding of the driver over the slide face, the rear edge of the driver preferably runs inclined by a second angle of inclination in relation to the longitudinal axis, wherein the second angle of inclination is greater in magnitude than the first angle of inclination. In particular, it is preferred that the second angle of inclination is at least 50% greater, more preferably at least twice as large as the first angle of inclination. In practice, an angle of inclination of the rear edge within the range of about 30°-45° has proved successful. Should the rear edge be continuously curved in relation to the longitudinal axis, these data relate to the angle of inclination in the middle of the rear edge.

The resulting driver has in its upper region, close to the cover wall of the cap, its greatest extent along the circumferential direction, while this extent increasingly diminishes in the downward direction (toward its free end). As a result, the driver is most stable where the greatest forces are at play during first-time opening, namely in the upper region which is active at the start of the opening movement, when the self-opening sleeve begins to split the packaging wall. Moreover, by virtue of this design, the reaction forces which act on the driver during opening and closing are transmitted particularly well to the cover wall of the cap and thus to the whole of the cap structure, and a situation in which there are places in which excess stresses arise in the material, which stresses could lead to deformations or even to breaking off of the driver, is avoided. Due to this optimized force transmission, the driver can be produced particularly thin in the radial direction. This not only has advantages for the production (lower material consumption), but also minimizes the forces involved in the reclosure, since a thinner driver can more easily be deflected inward.

In order to prevent the self-opening sleeve from falling downward out of the pouring spout, on the lower end of the pouring spout can be configured a radially inwardly extending holding cam. In addition, measures are conceivable to prevent the self-opening sleeve from moving back in the direction of the starting position, for example measures which provide that the axial distance between two threaded segments of the internal thread is tapered at the lower end of the pouring spout in order to produce a clamping effect on a therewith cooperating turn of the external thread of the self-opening thread.

The self-opening sleeve preferably has a supporting ring, on which the external thread is configured, as well as a first tooth, which extends downward protruding from the supporting ring, and which defines a front cutting edge. The front cutting edge is preferably inclined by a third angle of inclination relative to the longitudinal axis. This angle preferably corresponds to at least the pitch angle of the internal thread of the pouring spout, preferably to at least double this pitch angle. As a result, the cutting edge acts on the packaging wall partly along the motional direction of the self-opening sleeve, and partly downward, during cutting.

The self-opening sleeve can have a second tooth, which, with respect to the opening direction, follows the first tooth. If precisely two teeth are present, i.e. if the self-opening sleeve otherwise has no further teeth, it is preferred if the second tooth follows the first tooth at an angular distance of about 90°-180°, preferably of about 110°-150°, particularly preferably of about 130°, with respect to the peripheral direction or opening direction, measured from tip to tip. It is also conceivable, however, for the self-opening sleeve to have three or more teeth, in which the case the distance between the teeth should be chosen correspondingly smaller.

A self-opening sleeve having precisely two teeth at said distance apart has proved successful, above all, in composite packagings in which a hole has been punched out in the cardboard support already prior to the lamination of the plastics and, if need be, metal layers. In prepunched packagings of this kind, this hole is spanned by a film composite, which can be fairly tough and in some circumstances very extensible and which thereby resists being torn open. Since precisely two teeth act on the film composite, during opening the film composite is clamped, so to speak, between two tooth tips. As a result, the film composite rips more easily. It has also been confirmed in trials that for prepunched packagings two teeth are optimal. Closures having just one tooth or having precisely three teeth can also however be used.

Preferably, the second tooth extends downward with respect to the longitudinal axis substantially equally as far as the first tooth. As a result, two regions of the film composite are reached simultaneously by the tooth tips, so that the clamping effect sets in early and a high tearing effect is obtained.

Preferably, the second tooth has a front cutting edge, which runs substantially at the same angle of inclination relative to the longitudinal axis as the front cutting edge of the first tooth. As a result, both teeth have the same cutting effect. This has a positive impact on the further opening operation once the film composite has been torn.

Between the first tooth and the second tooth can be continuously configured a ring segment (a material region in the shape of a cylinder wall segment), which extends downward from the supporting ring, wherein this ring segment, after the closure has been opened for the first time, projects jointly with the first and second tooth downward from the pouring spout, to be precise in particular by at least 1 mm. This material region, on the one hand, reinforces the self-opening sleeve and thus contributes to the stability thereof. On the other hand, such a material region can also serve to keep the cut-out packaging segment ("flap") away from the pouring opening after the cutting operation.

In order to nevertheless ensure good residue emptying, the self-opening sleeve preferably has a segment along its periphery, which, after the closure has been opened for the first time, remains substantially fully within the pouring spout. In other words, there is a peripheral region in which the self-opening sleeve, after the closure has been opened for the first time, does not protrude downward from the pouring spout, or protrudes from the pouring spout at most by the thickness of the packaging wall, in concrete terms at most by about 1 mm, preferably no more than 0.5 mm. In this region (hereinafter referred to as the "residue emptying gap"), the content of the container can make its way unhindered into the pouring spout without a part of the self-opening sleeve getting in the way.

In order to prevent unintentional movement of the self-opening sleeve following fitting of the closure, for example as a result of vibrations during the application or during the later transport, the self-opening sleeve can have on its inner side, at a certain distance from the driving cam, a fixing cam. After the closure has been assembled and before the closure has been opened for the first time, the driver is located between the driving cam and the fixing cam. As a result, the mobility of the self-opening sleeve in relation to the driver (and thus in relation to the screw cap) is limited. Ideally, such a movement (play) of the self-opening sleeve is fully prevented. At the very least, however, the play is limited to a small angular range, for example of max. 20°.

BRIEF DESCRIPTION OF THE DRAWINGS

Preferred embodiments of the invention are described below on the basis of the drawings, which serve merely for illustration and should not be interpreted restrictively. In the drawings.

DESCRIPTION OF PREFERRED EMBODIMENTS

Figure 3:
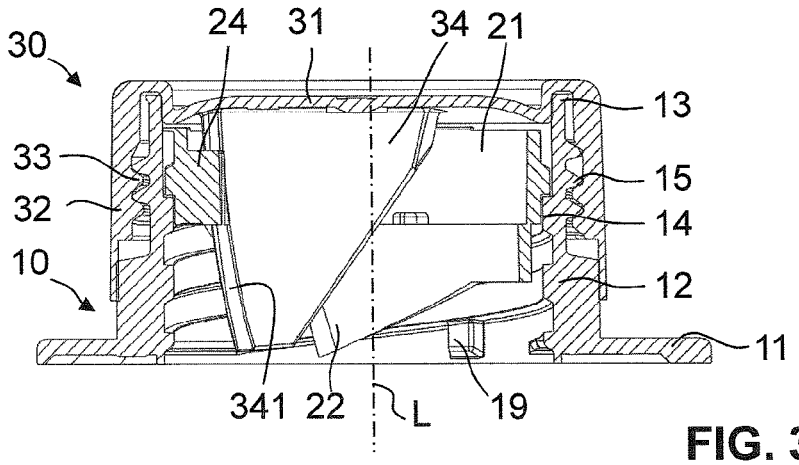
FIG. 3 shows a central longitudinal section through the closure of FIG. 1 in its starting position.
Figure 4:
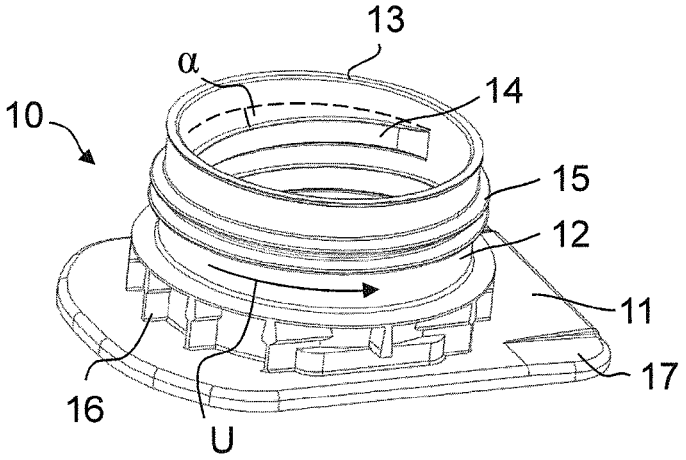
FIG. 4 shows a perspective view of the base of the closure of FIG. 1.
Figure 5:
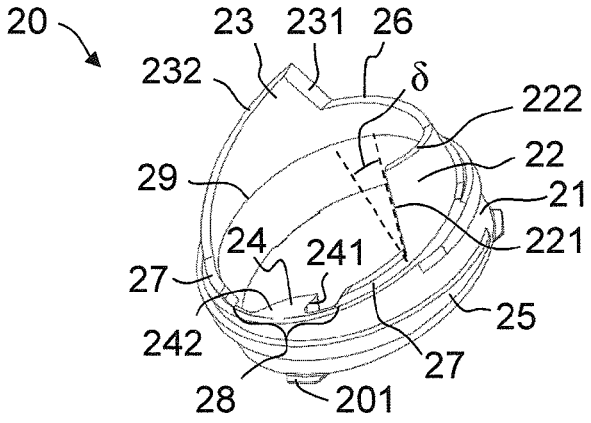
FIG. 5 shows a perspective view of the self-opening sleeve of the closure of FIG. 1.
Figure 6:
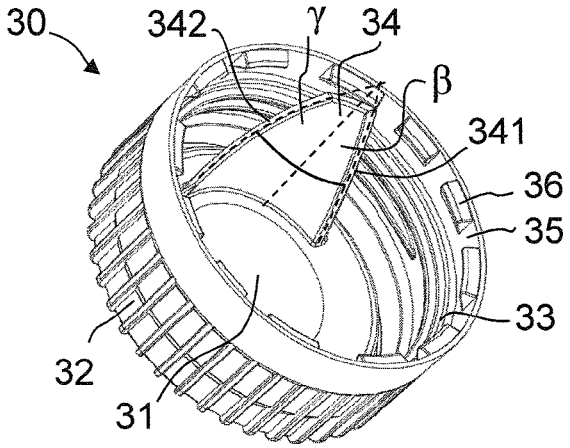
FIG. 6 shows a perspective view of the cap of the closure of FIG. 1.

In FIGS. 1 to 7, a first embodiment of a closure according to the invention is illustrated in different views. This variant of the closure is particularly well suited to composite packagings having a cardboard layer with prepunched opening which is overlaminated with plastics films and, if need be, a metal foil. The closure consists of a base 10, which in FIG. 4 is represented in isolation, of a self-opening sleeve 20, which in FIG. 5 is represented in isolation, and of a cap 30, which in FIG. 6 is represented in isolation.

The base 10 has a base plate 11 for connecting the closure to a packaging wall (not represented). The base plate 11 has a circular opening, which is surrounded by a tubular, cylindrical pouring spout 12. The pouring spout 12 extends upward from the base plate 11 up to a circumferential, circular upper rim 13. The pouring spout 12 defines, due to its cylindrical basic shape, a central longitudinal axis L (see FIG. 3), as well as an opening direction U along its periphery (see FIG. 4). A radial direction is accordingly a direction which extends from the central longitudinal axis L outward in the direction of the peripheral wall of the pouring spout 12.

On the inner side of the pouring spout 12 is configured an internal thread 14, which has a pitch angle $\alpha$ relative to a plane running perpendicular to the longitudinal axis 11. In the present example, this is constituted by a double thread having a pitch angle $\alpha$ of about 6.5° and about 1.5 windings. On the lower end of the thread 14 is configured a holding cam 19. On the outer side of the pouring spout 12 is configured an external thread 15, which has a significantly smaller pitch angle than the pitch angle $\alpha$ of the internal thread. Beneath the external thread are disposed on the base 10 a plurality of retaining webs 16, which cooperate with a guarantee band described in further detail below. Ramps 17 on the base plate 11 aid the transport of the closure in an application device. Reinforcing ribs 18 strengthen the base plate 11 on its bottom side.

The self-opening sleeve 20 has a supporting ring 21, on which two teeth 22, 23 are configured. The supporting ring 21 is provided on its outer side with an external thread 25, which is complementary to the internal thread 14 of the pouring spout 12. In the present example, the (likewise double) external thread 25 extends over somewhat more than half a winding.

On the inner side of the supporting ring 21 is configured a hook-shaped driving cam 24. This defines a guide face 241, which is inclined to the longitudinal axis L and is not configured flat, but concavely curved, with respect to the radial direction. The guide face 241 has no sharp bends whatever. The guide face is about 4 mm long. Before the guide face 241, viewed in the opening direction, the driving cam 14 is of wedge-shaped or ramp-shaped configuration and forms a ramp-like slide face 242 which is inclined inward in the opening direction. This slide face 242 has no steps or bends and merges steplessly into the cylindrical inner peripheral face of the supporting ring 21.

Figure 7:
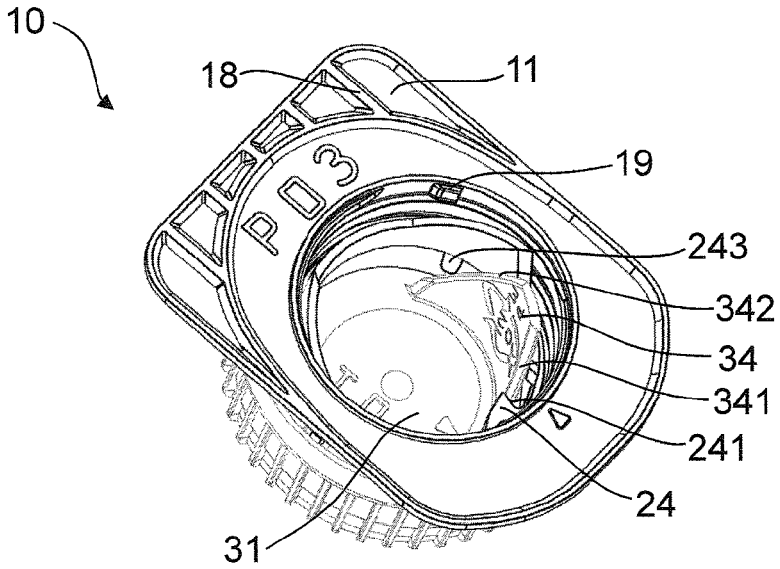
FIG. 7 shows a perspective view of the closure of FIG. 1 in its starting position.

At some distance from the driving cam, situated behind the driving cam in the opening direction, is found a fixing cam 243, which is discernible in FIG. 7.

Each of the two teeth 22, 23 has a front cutting edge 221 and 231 respectively, as well as a blunt rear edge 222, 232. The front cutting edge 221 or 231 is inclined downward by an angle δ relative to the longitudinal axis. In the present example, the angle of inclination is about 18°. The rear edge 222 or 232 runs at an angle to the longitudinal axis L which is greater than the angle δ. In the present example, this angle is about 65°. The two teeth have a distance apart of about 120° along the peripheral direction. Between the first and the second tooth is configured a ring segment 26 (i.e. a material region in the shape of a cylinder wall segment), which extends downward from the supporting ring 21. Before the first tooth 22 and behind the second tooth 23, viewed in the opening direction, are configured further ring segments 27, which extend downward from the supporting ring 21, however, only by a comparatively small section. Between these two ring segments 27 there is a gap, which defines a residue emptying region 28 and the function of which is explained in greater detail below. The teeth 22, 23 and lateral wall regions 26, 27 are offset slightly radially inward in relation to the supporting ring 21. Between them is configured, on the inner side of the self-opening sleeve 20, a circumferential edge 29, which, in the residue emptying region 28, at the same time forms the bottom edge of the self-opening sleeve 20.

The cap 30 has a cover wall 31 and a circumferential, substantially cylindrical side wall 32. On the inner side of the side wall 32 is configured an internal thread 33, which cooperates with the external thread 15 on the pouring spout 12. From the cover wall 31, a single driver 34 extends axially downward. The driver 34 forms a front edge 341 and a rear edge 342. The front edge 341 is inclined relative to the longitudinal axis L by an angle β. The angle β amounts in the present example to about 20°. It is thus significantly greater than the pitch angle α of the internal thread 14 in the pouring spout 12. The rear edge 342 is inclined relative to the longitudinal axis L by an angle γ. The angle γ is in the present case about twice as large in magnitude as the angle β and has the opposite sign hereto. The driver has the basic shape of a cylinder wall segment, wherein the helical front edge of the cylinder wall segment forms the aforementioned front edge 341 of the driver and the helical rear edge of the cylinder wall segment forms the aforementioned rear edge 342 of the driver. The bottom edge of the driver runs perpendicular to the longitudinal axis. The front edge 341 of the driver 34 is configured, in a region extending over the entire length of the front edge 341, complementary to the guide face 241 of the driving cam 24. As a result, this region of the front edge 341 bears squarely against the guide face 241.

On the lower end of the side wall 32 of the cap 30 is configured a guarantee band 35 having inwardly directed retaining cams 36. Between side wall 32 and guarantee band 35, a cut is executed prior to fitting ("slitting"), so that the guarantee band remains connected to the rest of the cap only by thin material regions. The retaining cams 36 cooperate with the retaining webs 16 on the base 10 in order to prevent the co-rotation of the guarantee band 35 when the closure is opened for the first time. As a result, upon first-time opening, the guarantee band 35 is separated from the rest of the cap, falls downward onto the base plate 11 and thus indicates the first opening. Possible other configurations of the guarantee band are known from the prior art.

The closure is preferably produced in two pieces, wherein the base 10 and the self-opening sleeve 20 are produced in one piece in a single injection mold, for example from HDPE. To this end, the self-opening sleeve 20, following production, is initially connected on its top edge by narrow material bridges 201 (FIG. 5) to the bottom side of the base 10; these material bridges are broken upon fitting of the closure. The cap 30 is produced in a separate injection mold and can consist of the same material as the base 10 and the self-opening sleeve 20. Such a two-piece production of the closure is in principle known from the prior art.

The closure is fitted by pressing the self-opening closure 20 axially into the pouring spout 12 and pressing the cap 30 axially onto the pouring spout 12. The closure is then in its starting position, which is illustrated in FIGS. 3 and 7. The self-opening sleeve 20 is here fully within the pouring spout 12. As can be seen in FIG. 7, in this position the driver 34 is disposed between the driving cam 24 and the fixing cam 243. As a result, unintended rotation of the self-opening 20 in the fitted closure is prevented. In this form, the closure is positioned above an overlaminated opening of the packaging wall and fastened (for example welded or glued) onto the packaging wall.

Figure 1:
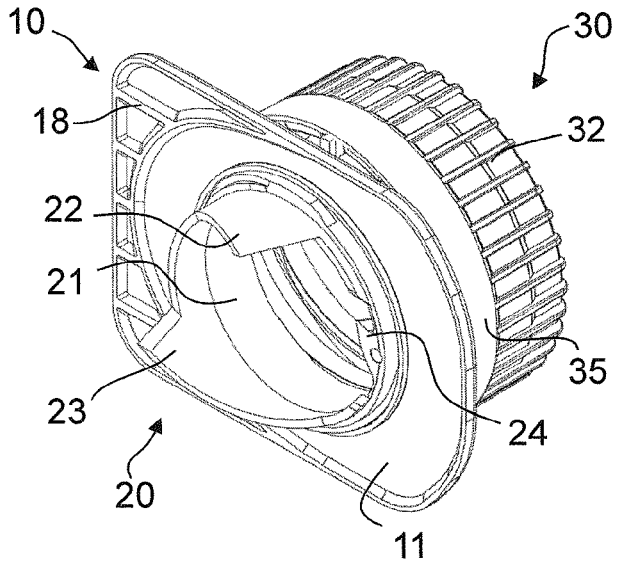
FIG. 1 shows a perspective view of a closure according to a first embodiment in its opening position.
Figure 2:
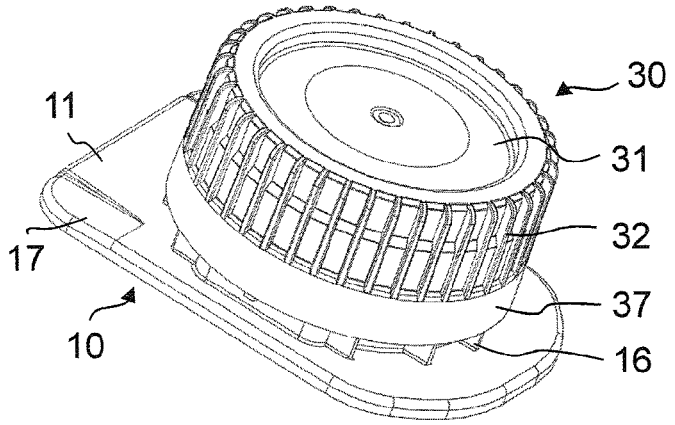
FIG. 2 shows a further perspective view of the closure of FIG. 1.

For the first-time opening of the packaging, the user turns the cap 30 counterclockwise (i.e. in the opening direction U). By means of the driver 34 and the driving cam 24, the cap 30 here transports the self-opening sleeve 20 and sets this likewise in rotation. The front edge 341 of the driver 34 bears on the guide face 241 of the driving cam 24 over the entire length of the driving cam 24 and slides on said guide face. Due to the threaded joint between the self-opening sleeve 20 and the pouring spout 12, the self-opening sleeve 20 moves helically downward. The teeth 22, 23 here pierce the laminated films, and, if need be, the metal layer, on the opening of the packaging wall, and afterward further cut these open. The cap 30 transports the self-opening sleeve 20 until such time as this has reached its lower opening position, as is illustrated in FIG. 1. At this point, the external thread 15 on the pouring spout 12 and the internal thread 33 on the cap 30 cease to engage in each other, and the cap 30 can be pulled off the pouring spout 12. The self-opening sleeve is prevented by the holding cam 19 from being further rotated downward, so that it cannot fall downward out of the pouring spout 12. The teeth 22, 23 and the ring segments 26, 27 now project downward from the pouring spout 12. In the residue emptying region 28, the self-opening sleeve 20, by contrast, does not project downward from the pouring spout 12, or at least does not project downward beyond the packaging wall. The residue emptying of the container is thereby facilitated.

When the closure is opened for the first time, the driver 34 exerts on the driving cam 24 a force which is directed obliquely downward. As a result of this force transmission between driver 34 and driving cam 24, the downward movement of the self-opening sleeve 20 is aided. The here acting reaction forces are transmitted over the entire length of the base of the driver 34 to the cover face 31 of the cap 30, without generation of excessive stresses. All in all, an almost optimal force transmission is in this way ensured. As a result of the hook-like configuration of the driving cam 24, a radial swerving of the driver 34 in the inward direction is here prevented.

For re-closure, the user places the cap 30 back onto the pouring spout 12 and screws the cap 30 back onto the pouring spout 12. The driver 34 here slides with its rear edge 342 over the slide face 242 of the driving cam 24 and is here deflected radially inward, so that the self-opening sleeve 20 remains in its lower opening position.

Figure 8:
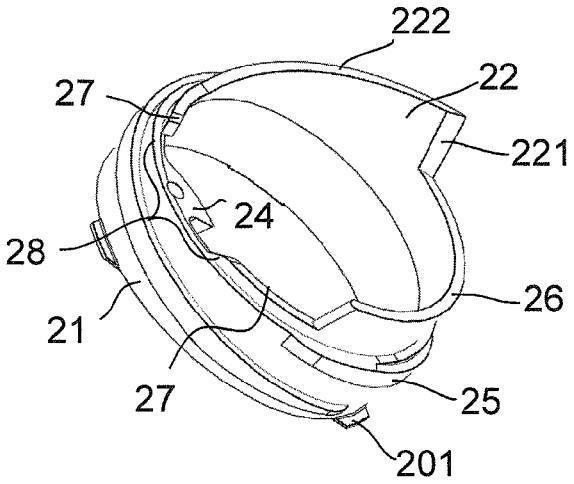
FIG. 8 shows a perspective view of a self-opening sleeve of a closure according to a second embodiment, having only one tooth.

In FIG. 8, a self-opening sleeve (cutting ring) according to a second illustrative embodiment is illustrated by way of example. Mutually corresponding parts are provided with the same reference symbols as in the embodiment of FIGS. 1 to 7. This embodiment is in particular suited to packagings which have no prepunched and overlaminated opening. In particular, the packaging can be made of a single-layered plastics wall. In this case, it is advantageous to provide just a single tooth 22. In this way, the opening forces are optimally concentrated on a single point. Apart from this, the closure of FIG. 8 is configured substantially the same as that of FIGS. 1 to 6.

Figure 9:
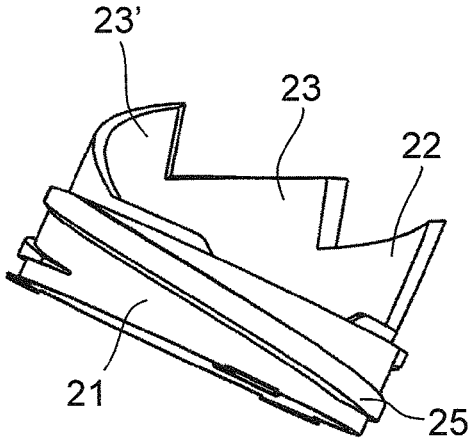
FIG. 9 shows a perspective view of a self-opening sleeve of a closure according to a third embodiment, having three teeth.

A self-opening sleeve (cutting ring) according to a third illustrative embodiment is represented by way of example in FIG. 9. Here three teeth 22, 23, 23' are present, the tips of which are spaced apart by respectively about 70°. Otherwise, mutually corresponding parts are in turn provided with the same reference symbols as in the embodiment of FIGS. 1 to 7.

Of course, a large number of modifications are possible without departing from the scope of the invention. It is in particular conceivable not to connect the cap by a threaded joint to the pouring spout, but, for example, to provide a bayonet-type connection in which the cap firstly, upon opening, performs a pure rotation and is subsequently pulled off axially. It is clear that such a variant has only a small influence on the cooperation of the driver with the driving cam. The shape of the tooth or teeth can also, of course, be chosen differently than in the present example. In addition, a (blunt) tooth-like hold-down device can be provided in order to bend back the cut-out segment of the packaging wall ("flap") downward, into the inside of the packaging, so that this cutout does not impede the pouring out of the content of the packaging. Designs of this type are in principle known from the prior art. The pouring spout can be configured, instead of on a separate base element, essentially also in one piece with the packaging wall, or can form the upper end of a bottle neck. A large number of further modifications is possible.

The invention claimed is:

1. A self-opening closure, comprising:

a tubular pouring spout, which defines a longitudinal axis and is provided on its inner side with an internal thread having a pitch angle, a cap, which upwardly covers the pouring spout and which, for the purpose of opening the closure, is rotatable in an opening direction and, for the purpose of reclosing the closure, is rotatable in a closing direction opposite to the opening direction, wherein the cap comprises at least one driver, which defines a front edge; and a self-opening sleeve, which is provided with an external thread that engages in the internal thread of the pouring spout, and which on its inner side comprises at least one driving cam, wherein the driving cam defines a guide face which, when the closure is opened for the first time, cooperates with the front edge of the driver in order to move the self-opening sleeve in the pouring spout in a screw-like manner downward out of an starting position into an opening position, wherein the front edge runs inclined downward by a first angle of inclination relative to the longitudinal axis, wherein the guide face runs inclined by the same angle of inclination as the front edge relative to the longitudinal axis, and wherein the first angle of inclination of the front edge of the driver is greater than or equal to the pitch angle of the internal thread of the pouring spout.

2. The self-opening closure as claimed in claim 1, wherein the guide face is configured with a continuously concave curvature with respect to a radial direction, so that it embraces the front edge of the driver when the closure is opened for the first time.

3. The self-opening closure as claimed in claim 2, wherein the front edge of the driver is convexly curved.

4. The self-opening closure as claimed in claim 2, wherein the front edge of the driver has at least in some areas a shape which is complementary to the shape of the guide face of the driving cam.

5. The self-opening closure as claimed in claim 2, wherein the guide face, when the closure is opened for the first time, bears along the whole of its length against the front edge of the driver.

6. The self-opening closure as claimed in claim 1, wherein the driving cam is of ramp-shaped configuration before the guide face with respect to the opening direction, with a slide face directed inward obliquely to the opening direction, which slide face merges smoothly into an inner cylindrical lateral surface of the self-opening sleeve, and wherein the driver, when the closure is reclosed, slides over the slide face of the driving cam.

7. The self-opening closure as claimed in claim 6, wherein the driver defines a rear edge, which runs inclined by a second angle of inclination relative to the longitudinal direction, wherein the second angle of inclination is greater in magnitude than the first angle of inclination.

8. The self-opening closure as claimed in claim 1, wherein the self-opening sleeve comprises a supporting ring, on which the external thread is configured, as well as at least a first tooth, which extends downward protruding from the supporting ring, and which defines a front cutting edge.

9. The self-opening closure as claimed in claim 8, wherein the self-opening sleeve comprises a second tooth, which, with respect to the opening direction, follows the first tooth at an angular distance of 90°-180°, measured from tip to tip, and wherein the self-opening sleeve otherwise comprises no further teeth.

10. The self-opening closure as claimed in claim 9, wherein the second tooth extends downward with respect to the longitudinal axis equally as far as the first tooth.

11. The self-opening closure as claimed in claim 9, wherein the second tooth has a front cutting edge, which runs substantially at the same angle of inclination relative to the longitudinal axis as the front cutting edge of the first tooth.

12. The self-opening closure as claimed in claim 9, wherein between the first tooth and the second tooth is continuously configured a ring segment, which extends downward from the supporting ring, wherein this ring segment, after the closure has been opened for the first time, projects jointly with the first and second tooth downward from the pouring spout.

13. The self-opening closure as claimed in claim 1, wherein the self-opening sleeve has a peripheral region in which the self-opening sleeve, after the closure has been opened for the first time, projects at most by about 1 mm downward from the pouring spout.

14. The self-opening closure as claimed in claim 1, wherein the self-opening sleeve has on its inner side a fixing cam, and wherein the driver, before the closure has been opened for the first time, is disposed between the driving cam and the fixing cam in such a way that the self-opening sleeve is movable by at most 20° in relation to the screw cap.

15. The self-opening closure as claimed in claim 1, wherein the self-opening sleeve has a peripheral region in which the self-opening sleeve, after the closure has been opened for the first time, does not project downward from the pouring spout.

16. The self-opening closure as claimed in claim 1, wherein the self-opening sleeve has on its inner side a fixing cam, and wherein the driver, before the closure has been opened for the first time, is disposed between the driving cam and the fixing cam in such a way that the self-opening sleeve is immovable in relation to the screw cap.

17. A self-opening closure, comprising:

a tubular pouring spout, which defines a longitudinal axis and is provided on its inner side with an internal thread having a pitch angle, a cap, which upwardly covers the pouring spout and which, for the purpose of opening the closure, is rotatable in an opening direction and, for the purpose of reclosing the closure, is rotatable in a closing direction opposite to the opening direction, wherein the cap comprises at least one driver, which defines a front edge; and a self-opening sleeve, which is provided with an external thread that engages in the internal thread of the pouring spout, and which on its inner side comprises at least one driving cam, wherein the driving cam defines a guide face which, when the closure is opened for the first time, cooperates with the front edge of the driver in order to move the self-opening sleeve in the pouring spout in a screw-like manner downward out of an starting position into an opening position, wherein the front edge runs inclined downward by a first angle of inclination relative to the longitudinal axis, wherein the guide face runs inclined by the same angle of inclination as the front edge relative to the longitudinal axis, wherein the driving cam is of ramp-shaped configuration before the guide face with respect to the opening direction, with a slide face directed inward obliquely to the opening direction, which slide face merges smoothly into an inner cylindrical lateral surface of the self-opening sleeve, and wherein the driver, when the closure is reclosed, slides over the slide face of the driving cam.

18. The self-opening closure as claimed in claim 17, wherein the driver defines a rear edge, which runs inclined by a second angle of inclination relative to the longitudinal direction, wherein the second angle of inclination is greater in magnitude than the first angle of inclination.

19. A self-opening closure, comprising:

a tubular pouring spout, which defines a longitudinal axis and is provided on its inner side with an internal thread having a pitch angle, a cap, which upwardly covers the pouring spout and which, for the purpose of opening the closure, is rotatable in an opening direction and, for the purpose of reclosing the closure, is rotatable in a closing direction opposite to the opening direction, wherein the cap comprises at least one driver, which defines a front edge; and a self-opening sleeve, which is provided with an external thread that engages in the internal thread of the pouring spout, and which on its inner side comprises at least one driving cam, wherein the driving cam defines a guide face which, when the closure is opened for the first time, cooperates with the front edge of the driver in order to move the self-opening sleeve in the pouring spout in a screw-like manner downward out of an starting position into an opening position, wherein the front edge runs inclined downward by a first angle of inclination relative to the longitudinal axis, wherein the guide face runs inclined by the same angle of inclination as the front edge relative to the longitudinal axis, wherein the self-opening sleeve comprises a supporting ring, on which the external thread is configured, as well as at least a first tooth, which extends downward protruding from the supporting ring, and which defines a front cutting edge, wherein the self-opening sleeve comprises a second tooth, which, with respect to the opening direction, follows the first tooth at an angular distance of 90°-180°, measured from tip to tip, and wherein the self-opening sleeve otherwise comprises no further teeth, and wherein between the first tooth and the second tooth is continuously configured a ring segment, which extends downward from the supporting ring, wherein this ring segment, after the closure has been opened for the first time, projects jointly with the first and second tooth downward from the pouring spout.

* * * * *